US010058792B2

(12) United States Patent
Slepov

(10) Patent No.: US 10,058,792 B2
(45) Date of Patent: Aug. 28, 2018

(54) THREE-DIMENSIONAL GRID BEAM AND CONSTRUCTION SET THEREOF

(71) Applicant: Tibbo Technology Inc., Taipei Hsien (TW)

(72) Inventor: Dmitry Slepov, Taipei (TW)

(73) Assignee: Tibbo Technology, Inc., Taipei Hsien (TW)

( * ) Notice: Subject to any disclaimer, the term of this patent is extended or adjusted under 35 U.S.C. 154(b) by 0 days.

(21) Appl. No.: 15/183,519

(22) Filed: Jun. 15, 2016

(65) Prior Publication Data

US 2016/0375371 A1 Dec. 29, 2016

Related U.S. Application Data

(60) Provisional application No. 62/184,752, filed on Jun. 25, 2015.

(51) Int. Cl.
*A63H 33/12* (2006.01)

(52) U.S. Cl.
CPC ..... *A63H 33/12* (2013.01)

(58) Field of Classification Search
CPC .. A63H 33/12; A63H 33/1046; A63H 33/107; E04B 1/02
See application file for complete search history.

(56) References Cited

U.S. PATENT DOCUMENTS 1,472,536 A * 10/1923 Thomson ..... A63H 33/108 211/189
2,093,341 A * 9/1937 Reiche ..... A63H 33/102 446/104
2,100,658 A * 11/1937 Finch ..... A63H 33/04 446/122
2,493,435 A * 1/1950 Arehambault ..... A63H 33/088 446/122
3,165,750 A * 1/1965 Tell ..... H01Q 15/10 273/DIG. 2
3,235,975 A * 2/1966 Pierson ..... G09B 23/04 434/189
4,012,153 A * 3/1977 Pidgeon ..... F16B 7/185 403/170
4,209,934 A * 7/1980 Ogawa ..... A63H 33/108 16/225
4,602,908 A * 7/1986 Kroeber ..... A63H 33/088 446/124
4,719,738 A * 1/1988 Lee ..... E01C 5/04 404/34
5,013,245 A * 5/1991 Benedict ..... G09B 1/10 434/113
5,186,672 A * 2/1993 Tung ..... A63F 9/0098 446/108
5,306,198 A * 4/1994 Forman ..... A63F 9/0098 446/116

(Continued)

*Primary Examiner* — James M Ference
(74) *Attorney, Agent, or Firm* — Haverstock & Owens LLP

(57) ABSTRACT

Three-dimensional grid beams are provided. The three-dimensional grid beam as provided offers high construction precision and rigidity, thus allowing the construction set thereof to be used in industrial and laboratory applications. The construction set utilizing such three-dimensional grid beams with connectors for releasably interconnecting the three-dimensional grid beams is also provided.

14 Claims, 16 Drawing Sheets

(56) References Cited

U.S. PATENT DOCUMENTS 5,816,882 A * 10/1998 Guegan ..... A63H 33/12 446/113
5,924,906 A * 7/1999 Grafton ..... A63H 33/10 411/339
5,964,635 A * 10/1999 Krog ..... A63H 33/101 446/116
6,014,842 A * 1/2000 Matsubara ..... E04B 5/14 446/115
6,062,937 A * 5/2000 Kikuchi ..... A63H 33/042 446/484
6,322,414 B1 * 11/2001 Lin ..... A63H 33/10 446/122
D497,182 S * 10/2004 McCartney ..... D19/59
7,273,404 B2 * 9/2007 Kowalski ..... A63H 33/046 446/114
7,322,873 B2 * 1/2008 Rosen ..... A63H 33/042 446/124
7,802,410 B2 * 9/2010 Breaz ..... E04C 1/41 446/106
7,976,024 B1 * 7/2011 Stapleton ..... A63H 33/065 273/156
8,753,162 B2 * 6/2014 Jensen ..... A63H 33/101 446/108
8,888,552 B2 * 11/2014 Wizenberg ..... A63H 33/086 446/102
2004/0000114 A1 * 1/2004 Schools ..... E04B 2/18 52/505
2007/0130874 A1 * 6/2007 Teng-Fu ..... A47B 96/1408 52/633
2008/0139077 A1 * 6/2008 Patton ..... A63H 33/046 446/92
2008/0160875 A1 * 7/2008 Leicht ..... A63F 9/12 446/124
2008/0190054 A1 * 8/2008 Kelly ..... B21F 27/08 52/223.13
2009/0205997 A1 * 8/2009 Richards ..... A63H 33/108 206/579
2010/0071141 A1 * 3/2010 Reiner ..... E01D 15/124 14/73
2012/0032393 A1 * 2/2012 Leicht ..... A63H 33/106 273/156
2013/0227901 A1 * 9/2013 Zohar ..... E04C 1/397 52/309.1
2014/0273712 A1 * 9/2014 Uttley ..... A63H 33/102 446/121
2016/0375371 A1 * 12/2016 Slepov ..... A63H 33/12 446/85

* cited by examiner

THREE-DIMENSIONAL GRID BEAM AND CONSTRUCTION SET THEREOF

CROSS-REFERENCE TO RELATED APPLICATION

This application claims benefit of U.S. Provisional Patent Application No. 62/184,752, filed Jun. 25, 2015, the entire contents of which are hereby incorporated by reference.

BACKGROUND OF THE INVENTION

Field of the Invention

The present invention relates generally to construction sets and member parts thereof.

More particularly, this invention relates to an innovative three-dimensional grid beam and an innovative construction set utilizing said innovative three-dimensional grid beam. The innovative three-dimensional grid beam of the present invention offers high construction precision and rigidity, thus allowing the innovative construction set to be used for creating industrial and laboratory fixtures, apparatus, and assemblies. The innovative three-dimensional grid beam of the present invention also provides versatility, allowing the beam to be used in a variety of ways. Importantly, the beam can be used to form geometrically correct rectangles and cubes with "ideal" corners.

Further, whereas known constriction sets attempted to anticipate the user's needs by offering multiple parts in all imaginable shapes and configurations, the present invention takes into the account the recent advances in desktop 3D printing. Accordingly, the innovative construction set of the present invention does not attempt to offer all necessary parts. Rather, it is envisioned that small joints, end members, harnesses, brackets, and other special parts will be 3D-printed by the user in accordance with his or her unique needs, while the innovative three-dimensional grid beams of the present invention will form the rigid skeleton of a fixture, apparatus, or an assembly being created.

Description of the Prior Art

Construction sets based on grid beams are well-known in the industry and have been offered for sale, primarily as toys, for over a century. Said beams are alternatively referred to as "sticks", "strips", or "girders". The specifier "grid" refers herein to perforated holes punched in the beams at even intervals. Grid beams are joined together with screws inserted through said holes. Since a screw can only be inserted where a hole exists, and since the holes are punched at even intervals, the entire construction made of grid beams conforms to the predefined grid.

The two earliest and best-known grid beam construction toys were called the "Meccano set" and the "Erector kit". Although slightly different from each other in the implementation and each employing a different term for its grid beams, these toy sets universally relied on stamped metal beams as their main construction elements.

The grid beam was referred by the Meccano set as a "strip", and the Erector kit as a "girder". Users and printed publications also referred to the grid beam as a "stick".

A specimen of such a stamped metal beam is shown on FIG. 1. The stamped metal beam 1 is typically offered in varying lengths conforming to the grid step or pitch S. Each beam contains a row of punched holes 2, positioned at step intervals S. Beam length L along its main dimension (as indicated by the arrow 3) is equal to S multiplied by the number of steps N. The edges of the stamped metal beam 1 are usually rounded, with the left edge 4 and the right edge 5 being concentric with the leftmost and the rightmost hole 2, correspondingly.

Those skilled in the art will recognize that grid beams stamped out of sheet metal are essentially two-dimensional and, therefore, easily deform (bend) along the imaginary line 6, which is perpendicular to the main dimension of the stamped metal beam 1.

To reinforce the construction, both Meccano and Erector offered angled parts. Erector, in particular, was popular because of its angled beams that were referred to as "angled girders". A specimen of such an angled girder is shown on on FIG. 2. The angled girder 7 still conforms in length to the grid step S. Holes 2 are punched on both the side 8 and the side 9 of the angled girder 7. The left edge 10 and the right edge 11 are straight and not rounded as is the case with the grid beam 1 shown on FIG. 1.

Although mechanically stronger than a flat beam, the angled girder presented on FIG. 2 was still manufactured using a stamping and bending process. Thus, such angled girder represents a 2.5-dimensional design at best. It can still be bent with relative ease. In addition, the "stamp and bend" manufacturing process leads to the beam deformation whereas its sides are not at the perfect 90-degree angle θ to each other. Those skilled in the art will immediately realize that even a small angle error may lead to significant deviations and assembly difficulties when such non-ideal angled beam is used in large assemblies. The angled girder with three sides presented on FIG. 3 is stronger but is still not free from the angle error.

As a result, assemblies made from stamped beams are often wobbly or distorted. This may be acceptable in the toy domain but prevents the usage of described construction kits for "serious" applications in manufacturing and laboratory equipment.

Another class of widely available grid beams is manufactured using the metal alloy extrusion process. A specimen of such an extruded grid beam is shown on FIG. 4. The body of the extruded beam 12 has four sides and is hollow on the inside. Holes 2 perforate all four sides of the beam 12. As the beam is manufactured using the extrusion process, after which the beam is cut to the desired length, the left edge 10 and the right edge 11 of the beam are straight and expose the internal space 13 of the beam.

Extruded grid beams are structurally strong and their sides are typically very uniform, forming near-perfect straight angles with adjacent sides.

The disadvantage of extruded grid beams is in the inability to form a pure rectangle corner with them. This problem is illustrated by FIG. 5. The best corner that can be formed using extruded grid beams is, at best, a very crude approximation to the ideal. The resulting "rectangular" structure is not flat in the sense that its beams reside on two planes: one for each parallel beam pair.

Those skilled in the art will realize that this pseudo-rectangular structure is also unstable. As only a single screw fastens two adjacent beams together, nothing precludes the formed pseudo-rectangle from becoming a parallelogram. Only a diagonal brace 14 would prevent this pseudo-rectangle from deforming. The problem is that the same standard grid beam can't be used as a diagonal brace—none of the standard holes 2 will be in the right position for the job.

Problems illustrated by the example of this pseudo-rectangle extend into three-dimensional bodies. As with the rectangle corner, it is not possible to build an ideal cube (or square parallelepiped) corner with extruded grid beams. As with pseudo-rectangles, pseudo-cubes formed with extruded grid beams require diagonal braces to ensure structural stability, and such braces must be specially manufactured.

It must be noted that there exist variations on the described extruded grid beam 12 shown on FIG. 4. For example, there are grid beams manufactured from solid wood. Such beams exhibit the same problems as the aforementioned extruded grid beam.

The limitations described above prevent the use of existing construction sets in manufacturing and laboratory applications. Every year, factories, universities, research laboratories, and other organizations spend significant funds, efforts, and time machining custom fixtures. Many of these creations are fabricated in the quantity of one—never to be built again. The concept of erecting fixtures, apparatus, and assemblies from a set of standard parts is extremely appealing to these organizations. Accordingly, there exists the need for a professional construction set that is suitable for manufacturing and laboratory applications.

SUMMARY OF THE INVENTION

In view of the above, it is an object of the present invention to create an innovative three-dimensional grid beam that is rigid and precise enough to allow its use in professional industrial and laboratory applications.

It is another object of the present invention to create an innovative three-dimensional grid beam that allows constructing ideal rectangle and cube (square parallelepiped) corners.

It is yet another object of the present invention to create an innovative three-dimensional grid beam that allows constructing rectangle and cube (square parallelepiped) shapes without the explicit need to employ diagonal braces.

It is a further object of the present invention to provide an innovative construction set utilizing the aforementioned innovative three-dimensional grid beam.

To achieve the above objects, the present invention provides a solid (filled on the inside) three-dimensional grid beam fabricated, for example, from a metal alloy or reinforced plastic.

The beam is fabricated using any suitable manufacturing method such as injection molding, CNC machining, drilling, or any combination of these and other suitable manufacturing methods. Aforementioned materials and fabrication methods are provided here only for the reference purpose and should not be viewed as limiting the scope or the spirit of the present invention in any way.

Because the innovative three-dimensional grid beam of the present invention comprises a solid block of material, it possesses the necessary rigidity to be used in professional industrial and laboratory applications. Since the innovative three-dimensional grid of the present invention is manufactured using injection molding, and/or CNC machining, its faces may be fabricated to achieve the near-perfect 90-degree angles with respect to each other, thus ensuring the high precision of the beam dimensions and resulting structures erected with the use of this innovative beam. Therefore, the first object of the present invention is achieved.

Since the innovative three-dimensional beam of the present invention is of the grid type, it can be described as consisting of N sections of the standard step S. Each section has the length, width, and height equal to S. Preferably, each section accommodates a pair of holes on its vertical and horizontal faces. Preferably, there is also a pair of holes on the left face of the leftmost section, and on the right face of the rightmost section of the innovative three-dimensional grid beam. It must be noted that the terms "horizontal", "vertical", "left" and "right" are used herein and throughout the description of the present invention solely for the purpose of explanation and should not be viewed as limiting the spirit or the scope of the present invention in any way.

Preferably, holes on the horizontal and vertical faces of the innovative three-dimensional grid beam of the present invention are through holes. They can be said to "connect" one vertical face to another vertical face, and one horizontal face to another horizontal face.

Preferably, holes on the left and right faces of the innovative three-dimensional grid beam of the present invention are blind (not through) and drilled to the depth substantially equal to S/2.

It is envisioned that the innovative three-dimensional grid beam of the present invention can comprise any practical number of steps S, including S=1, which constitutes a special case. In this special case the innovative three-dimensional grid beam of the present invention is, essentially, a cube. Such a cube has through holes on all of its faces.

Further, the holes of each pair of holes on each face of each section of the innovative three-dimensional grid beam of the present invention lie on a first centerline, which dissects the face across the horizontal or vertical middle of each section. Further still, holes in hole pairs are centered with the respect to a second centerline, which dissects the face across the horizontal or vertical middle of each section in the direction perpendicular to the first centerline.

Further still, holes on any face of the innovative three-dimensional grid beam of the present invention do not intersect with holes on any adjacent face. This is because any pair of holes of any section of the three-dimensional grid beam always lies on the plane perpendicular to the planes hosting the pairs of holes on the adjacent faces of the three-dimensional grid beam.

It is envisioned that the innovative three-dimensional grid beam of the present invention can be fabricated in three variants that correspond to three distinct embodiments of the present invention.

According to the first embodiment of the present invention, holes on horizontal and vertical faces of the innovative three-dimensional grid beam are threaded, while the holes on the left and right faces are plain (non-threaded).

According to the second embodiment of the present invention, all holes on all faces of the innovative three-dimensional grid beam are threaded.

According to the third embodiment of the present invention, all holes on all faces of the innovative three-dimensional grid beam are plain (non-threaded).

Since the innovative three-dimensional grid beam of the present invention possesses holes on all faces, said grid beam can be assembled into rectangular and cubic (square parallelepiped) structures having "perfect" corners. Thus, the second object of the present invention is achieved.

As each section of the innovative three-dimensional grid beam according to the preferred embodiment of the present invention preferably has two holes per an exposed section face, assemblies made of said grid beams are self-supporting and do not explicitly require diagonal braces. As beam-to-beam joints are formed by flat beam surfaces and secured by two screws, the resulting structures are able to maintain rectangular shapes and rigidity without the explicit need for diagonal braces. Thus, the third object of the present invention is achieved.

It is envisioned that a complete construction set utilizing the innovative three-dimensional grid beam of the present invention may only include beams of three kinds: the beam according to the first embodiment of the present invention, the beam according to the second embodiment of the present invention, and the beam according to the third embodiment of the present invention.

Further, it is contemplated that it is only necessary to offer grid beams of varying lengths for grid beams according to the first embodiment of the present invention. Grid beams according to the second and third embodiments of the present invention may be offered only in single-step versions, i.e. as "cubes".

Preferably, the innovative construction set kit according to the present invention comprises three-dimensional grid beams according to the first embodiment of the present invention offered in varying number of steps N, three-dimensional grid beams according to the second and third embodiments of the present invention offered in a single-step (N=1) version only, and screws of two lengths—S×1.5, and S×2.5.

It is envisioned that all necessary additional specialized parts that are invariably required to complete any real-life project may be printed quickly and inexpensively using a desktop 3D printer. Thus, the fourth object of the present invention is achieved.

BRIEF DESCRIPTION OF THE DRAWINGS

It is to be understood that elements shown in the following drawings are shown for the purpose of better explanation and are not necessarily presented according to the actual size and scale. In addition, to make the drawings simple and easy to understand, certain elements already known in prior art are not shown in some of the drawings.

DETAILED DESCRIPTION OF THE PREFERRED EMBODIMENTS

To better understand the features, aspects, advantages, and effects produced by the present invention, the invention will now be described more fully hereinafter by way of example and with reference to the accompanying drawings, in which preferred embodiments of the present invention are shown. It should be noted that the following description and accompanying drawings are given only as exemplary and do not necessarily present the actual scale or precise configuration for practicing the present invention. Hence, the scale and configuration shown in any of the accompanying drawings should not be construed as limiting the scope of the claims for carrying out the invention. It is intended that the scope of the present invention is to be defined by the claims appended hereto.

Figure 6:
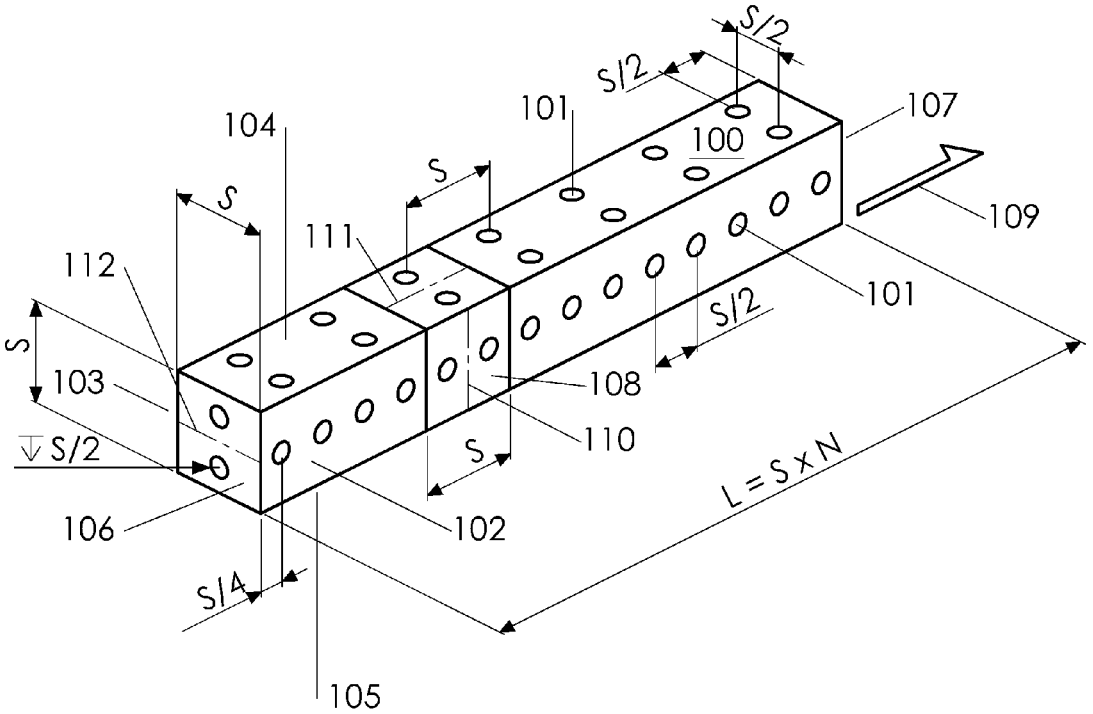
FIG. 6 shows an innovative three-dimensional grid beam according to the preferred embodiment of the present invention, whereas the number of steps N is greater than one.

Referring now to FIG. 6, there shown a three-dimensional grid beam according to the preferred embodiment of the present invention.

The innovative three-dimensional grid beam 100 comprises a cuboid solid block of material fabricated, for example, from a metal, metal alloy or reinforced plastic. The beam is fabricated using any suitable manufacturing method such as injection molding, CNC machining, drilling, or any combination of these and other suitable manufacturing methods. Aforementioned materials and fabrication methods are provided here only for the reference purpose and should not be viewed as limiting the scope or the spirit of the present invention in any way.

The cuboid solid block is defined by six faces that are substantially perpendicular to each other. These six faces consist of a first pair of opposing faces 102 and 103, a second pair of opposing faces 104 and 105, and a third pair of opposing faces 106 and 107. The length of faces 102, 103, 104, and 105 is S multiplied by N and the width thereof is S. The length and width of faces 106 and 107 is S. The three-dimensional grid beam is thereby described as consisting of the N number of sections 108, each of the sections 108 having the length of S, the width of S and the height of S. In the present invention, S is the grid step of the three-dimensional grid beam, and N is a positive integer greater than or equal to 1.

In the embodiment of the invention shown on FIG. 6, holes 101 perforate the first pair of opposing faces, i.e. vertical faces 102 and 103, as well as the second pair of opposing faces, i.e. horizontal faces 104 and 105 of the three-dimensional grid beam 100. The third pair of opposing faces, i.e. faces 106 and 107 on the left side and the right side of the three-dimensional grid beam are also perforated by holes 101. It must be noted that the terms "horizontal", "vertical", "left" and "right" are used herein and throughout the description of the present invention solely for the purpose of explanation and should not be viewed as limiting the spirit or the scope of the present invention in any way.

Since the innovative three-dimensional beam of the present invention is of the grid type, it utilizes a standard step length S. A three-dimensional grid beam having a length equal to a multiple N of steps S may be described as consisting of the N number of sections 108, each section having the length, height, and width equal to the step S. The innovative three-dimensional grid beam of the present invention can be made shorter or longer along the main dimension, e.g. the longitudinal axis 109 of the grid beam 100, and its length L always comprises a number of full steps S. It must be noted that borders of the section 108 are shown only for illustration purposes and should not be viewed as a feature of the innovative three-dimensional grid beam.

According to the preferred embodiment of the present invention, each section 108 of the innovative three-dimensional grid beam contains a pair of holes 101 on each of its faces 102, 103, 104, and 105. Hence, for each section 108 there is a pair of holes "connecting" faces 102 and 103, as well as a pair of holes "connecting" faces 104 and 105.

Further, the pairs of holes on faces 102 and 103 reside on the plane aligned with the main dimension 109, while the pairs of holes on faces 106 and 107 lie on the plane perpendicular to the dimension 109. Further still, holes 101 on faces 102 and 103 are equidistant from the center line 110, which dissects the vertical surface of the section 108 across its middle in the direction perpendicular to the main dimension 109. Holes 101 on faces 104 and 105 are equidistant from the center line 111, which dissects the horizontal surface of the section 108 across its middle in the direction parallel with the main dimension 109.

According to the preferred embodiment of the present invention, the distance between the centers of holes 101 in each pair of holes is equal to one half of the step length S. Hence, the holes on faces 102 and 103 form a row of holes positioned at equal S/2 intervals from each other. The center of the leftmost hole is at the distance of S/4 from the left face 106, and the center of the rightmost hole is at the distance of S/4 from the right face 107.

On faces 104 and 105, centers of paired holes are one S step away from each other in the direction aligned with the main dimension 109. The centers of holes of the leftmost hole pair are at the distance of S/2 from the left face 106, and the centers of holes of the rightmost hole pair are at the distance of S/2 from the right face 107.

Those skilled in the art will immediately realize that pairs of holes 101 connecting faces 102-103, and pairs of holes 101 connecting faces 104-105 do not intersect. This is because said pairs of holes reside on mutually perpendicular planes.

The left face 106 and the right face 107 each feature a pair of holes 101 as well. Because the three-dimensional grid beam according to the preferred embodiment of the present invention may consist of multiple sections 108, it may not be practical or possible to interconnect the holes on faces 106 and 107.

Hence, the holes 101 on faces 106 and 107 may be blind. According to the preferred embodiment of the present invention, said blind holes are drilled to the depth of S/2. This dimension is provided here for reference only and shall not be viewed as limiting the spirit or the scope of the present invention in any way.

Pairs of holes 101 in faces 106 and 107 are equidistant from the centerline 112, which dissects the left face 106 across the middle in the horizontal direction.

Those skilled in the art will, again, realize that none of the holes 101 of the innovative three-dimensional grid beam according to the preferred embodiment of the present invention intersects with any other holes 101 on the same grid beam. Any pair of holes on any face of the innovative three-dimensional grid beam always lies on the plane perpendicular to the planes hosting hole pairs of the adjacent faces.

As explained above, the innovative three-dimensional grid beam according to the preferred embodiment of the present invention may consist of any number of sections 108, with the number of sections N being limited only by the constraints of manufacturability, material rigidity, and practical applicability.

Figure 7:
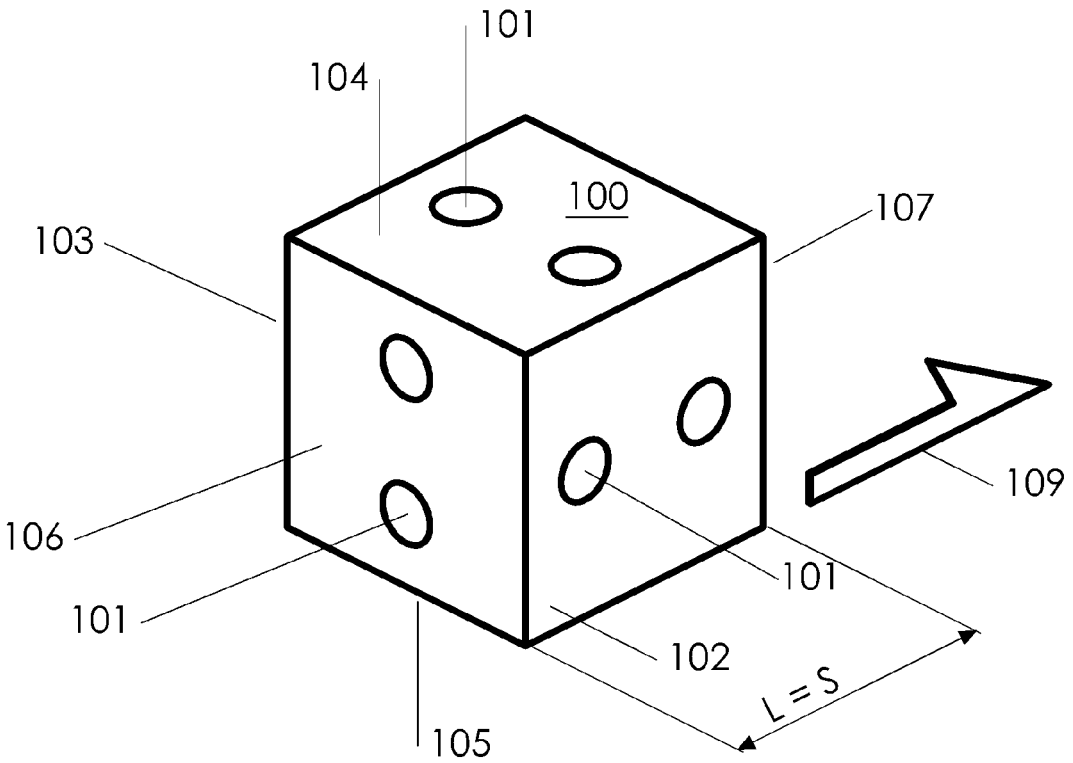
FIG. 7 shows a special case of the innovative three-dimensional grid beam according to the preferred embodiment of the present invention, whereas the number of steps N is equal to one.

One special case of the beam construction is the beam comprising a single section 108. Such three-dimensional grid beam 100, presented on FIG. 7, is essentially a solid cube block. This solid cube block has through holes 101 connecting all three pairs of its faces: 102 and 103, 104 and 105, as well as 106 and 107. As explained earlier, the depth of blind holes drilled in faces 106 and 107 is equal to S/2. Since the total length of the single-section three-dimensional grid beam along the dimension 109 is S, the drilling depth of S/2 on faces 106 and 107 results in a pair of through holes connecting faces 106 and 107.

According to the preferred embodiment of the present invention, holes 101 are dimensioned to have the diameter equal to S/5. It is envisioned, that some or all of the holes 101 may be fabricated with threading for screws with S/5 diameter, in which case the diameter of such threaded holes will actually be slightly smaller than S/5, as dictated by the standard fabrication process for threaded holes. Holes 101 without threading (plain holes) may be made slightly larger than S/5 in diameter. All such variations are completely within the spirit and the scope of the present invention.

Figure 8A:
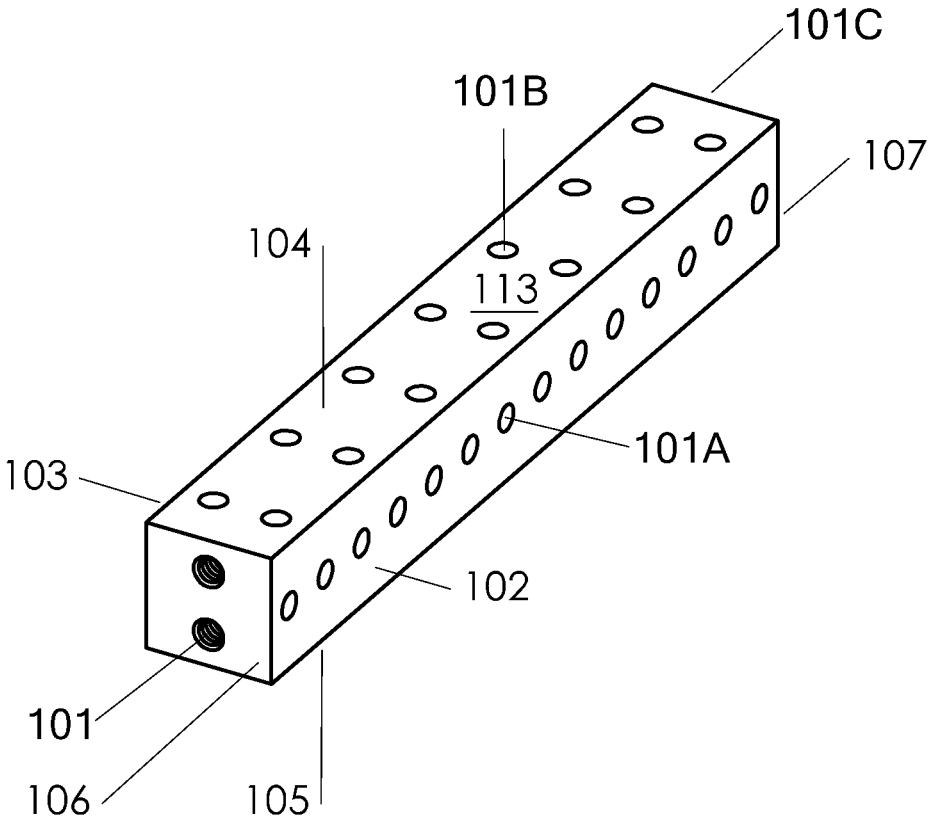
FIG. 8A shows the first embodiment of the present invention, whereas the innovative three-dimensional grid beam is fashioned both with threaded and plain (non-threaded) holes, and whereas the number of steps N is greater than one.

In the first embodiment of the present invention, only holes 101C on faces 106 and 107 of the innovative three-dimensional grid beam 113 are threaded, and the holes 101A, 101B connecting pairs of opposing faces 102-103 and 104-105 are plain and have no threading. The graphical representation of the first embodiment of the present invention is shown on FIG. 8A.

Figure 8B:
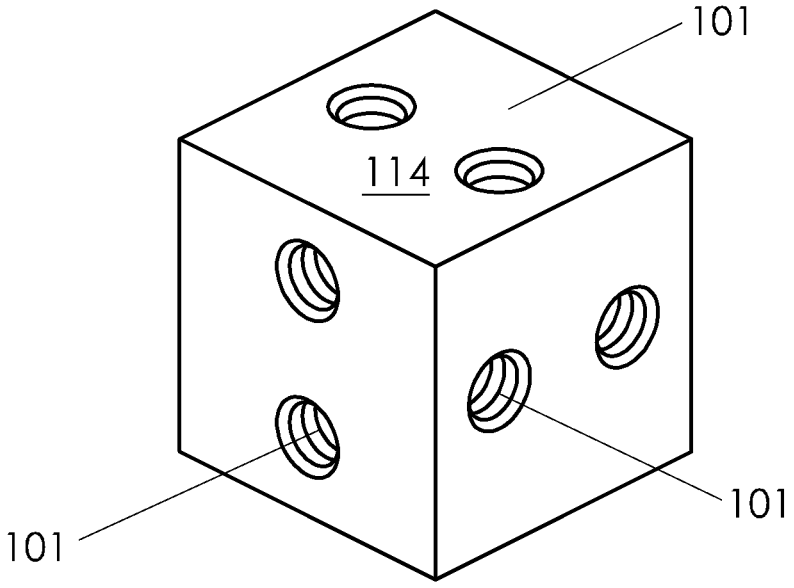
FIG. 8B shows the second embodiment of the present invention, whereas all holes of the innovative three-dimensional grid beam are threaded, and whereas the number of steps N is equal to one.

In the second embodiment of the present invention, all holes 101A, 101B and 101C of the innovative three-dimensional grid beam 114 are threaded. This is especially useful for the N=1 case when the three-dimensional grid beam of the present invention comprises a cube. The graphical representation of the second embodiment of the present invention is shown on FIG. 8B.

In the third embodiment of the present invention, none of the holes of the innovative three-dimensional grid beam 115 are threaded. That is, all of the holes 101A, 101B and 101C are plain and have no threading. Again, this is especially useful for the N=1 case when the three-dimensional grid beam of the present invention comprises a cube. The graphical representation of the third embodiment of the present invention is shown on FIG. 8C.

Because the innovative three-dimensional grid beam of the present invention comprises a solid block of material, it possesses the necessary rigidity to be used in professional industrial and laboratory applications. Since the three-dimensional grid of the present invention is manufactured using injection molding, and/or CNC machining, its faces may be fabricated to achieve the near-perfect 90-degree angles with respect to each other, thus ensuring high precision of the beam dimensions and resulting structures erected with the use of this innovative three-dimensional grid beam. Hence, the first object of the present invention is achieved.

Figure 1:
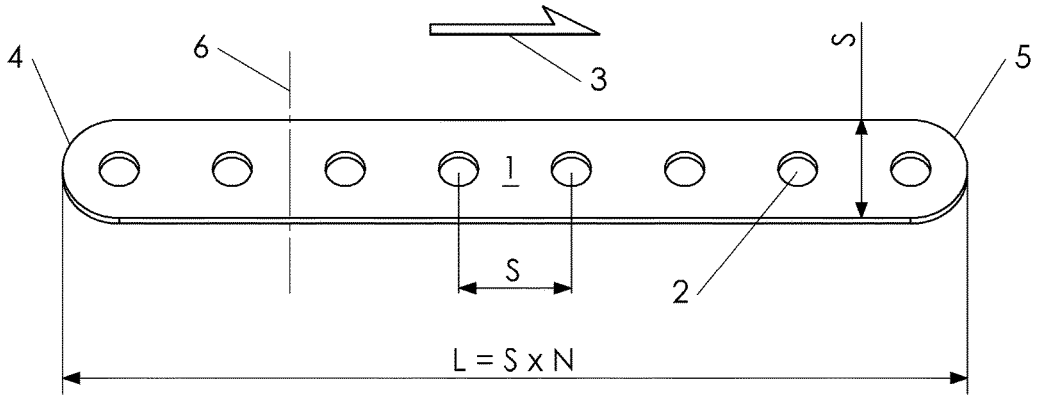
Fig. 1 (PRIOR ART)
FIG. 1 (PRIOR ART) shows a flat grid beam, also referred to as a "strip", made out of sheet metal using a stamping process.
Figure 2:
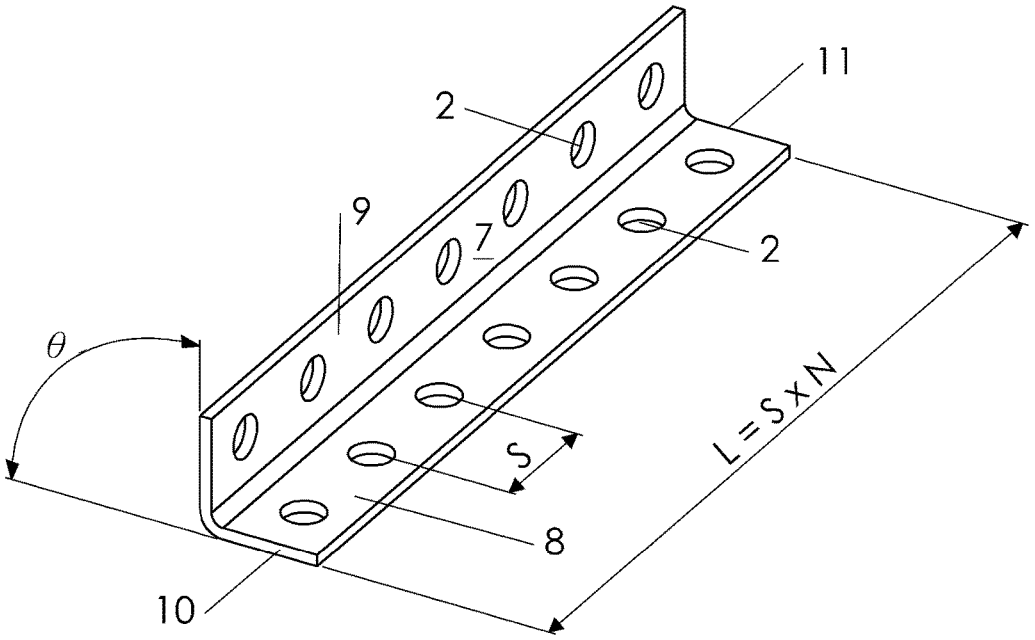
Fig. 2 (PRIOR ART)
FIG. 2 (PRIOR ART) shows a two-sided version of the angled grid beam, also referred to as an "angled girder", made out of sheet metal using a stamping and bending process.
Figure 3:
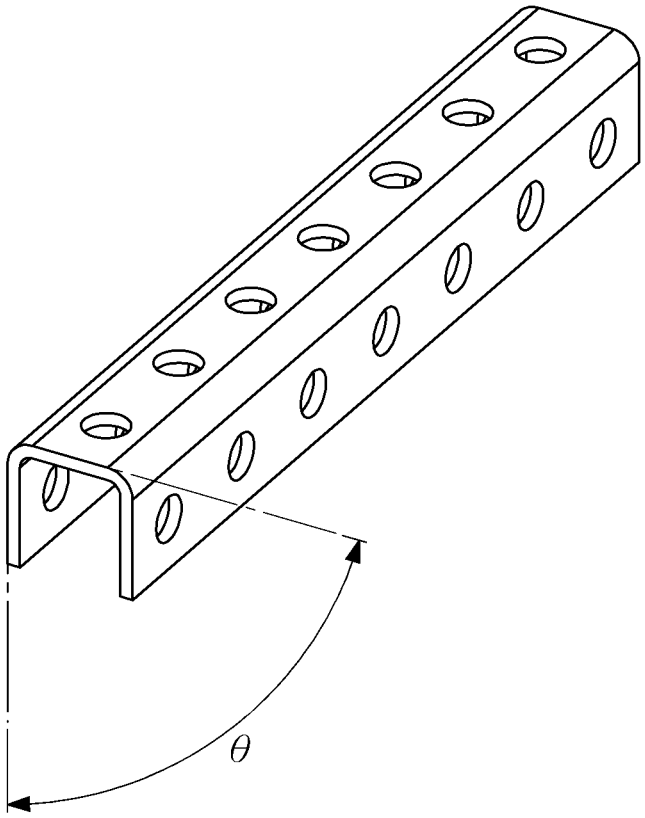
Fig. 3 (PRIOR ART)
FIG. 3 (PRIOR ART) shows a three-sided version of the angled grid beam, also referred to as an "angled girder", made out of sheet metal using a stamping and bending process.
Figure 4:
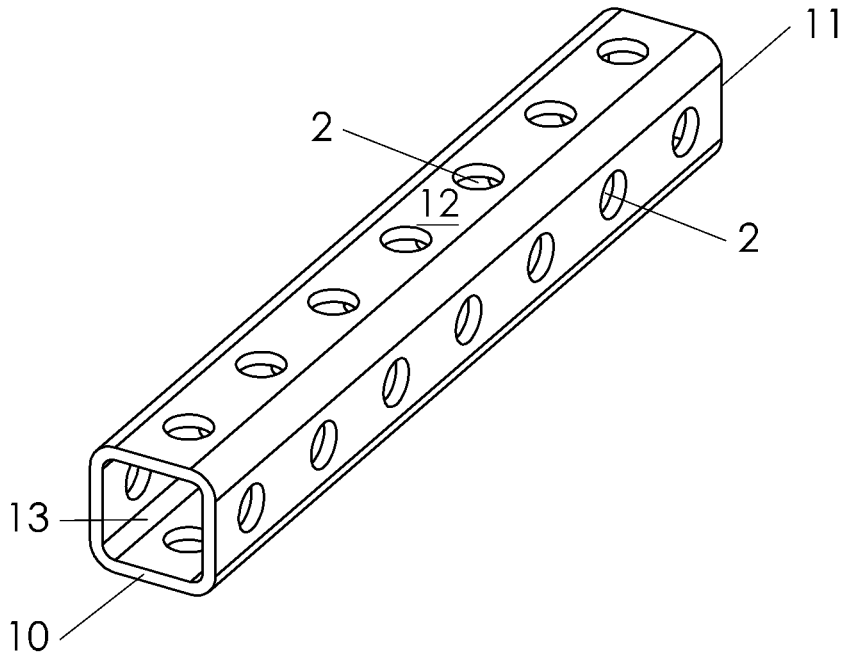
Fig. 4 (PRIOR ART)
FIG. 4 (PRIOR ART) shows an extruded grid beam.
Figure 5:
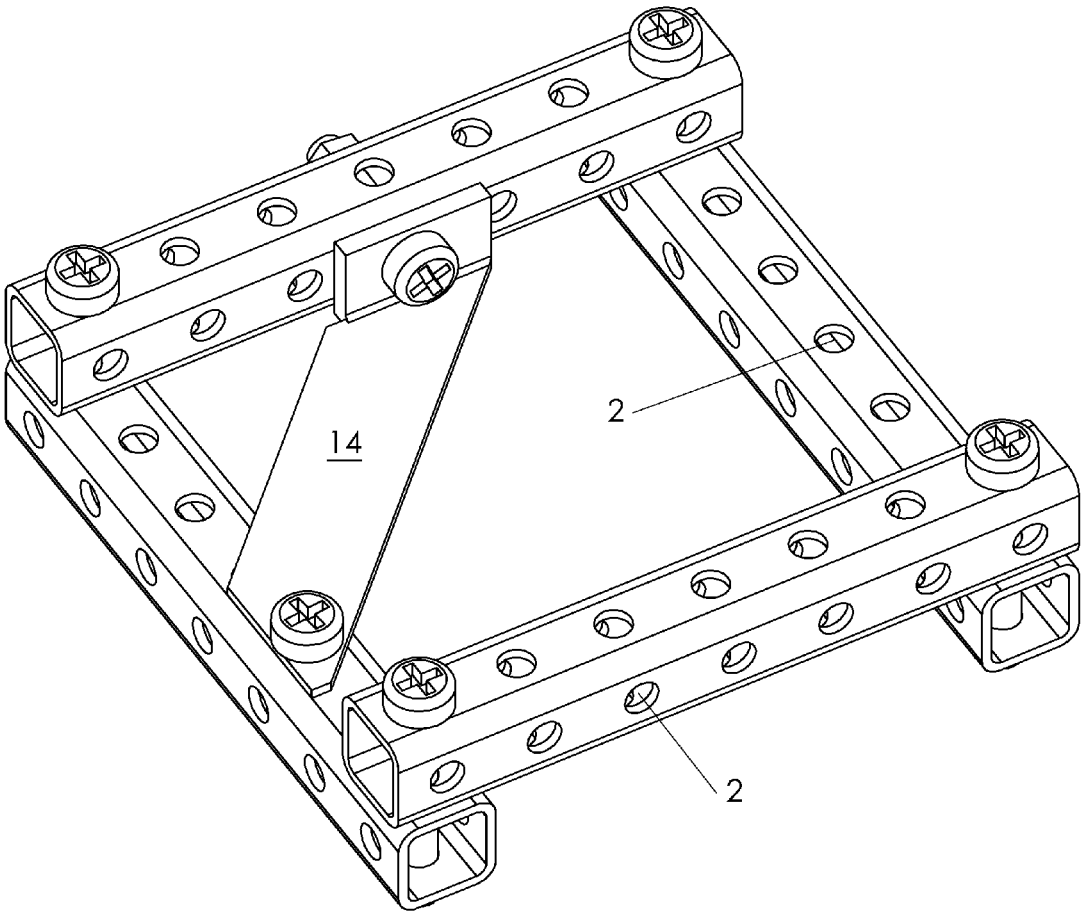
Fig. 5 (PRIOR ART)
FIG. 5 (PRIOR ART) illustrates limitations and difficulties with constructing a rectangular structure using extruded grid beams.

Since the innovative three-dimensional grid beam of the present invention possesses holes on all pairs of opposing faces 102-103, 104-105, and 106-107, said beam can be assembled into rectangular and cubic (square parallelepiped) structures having "perfect" corners. An example of a three-dimensional structure corner constructed with beams 113 and connectors 116, e.g. screws, of the kind described as the first embodiment of the present invention is presented on FIG. 9A. It is easy to see that this structure forms a "perfect" corner, in contrast to the crude corner approximation achievable with extruded grid beams (as seen on FIG. 5).

Figure 9A:
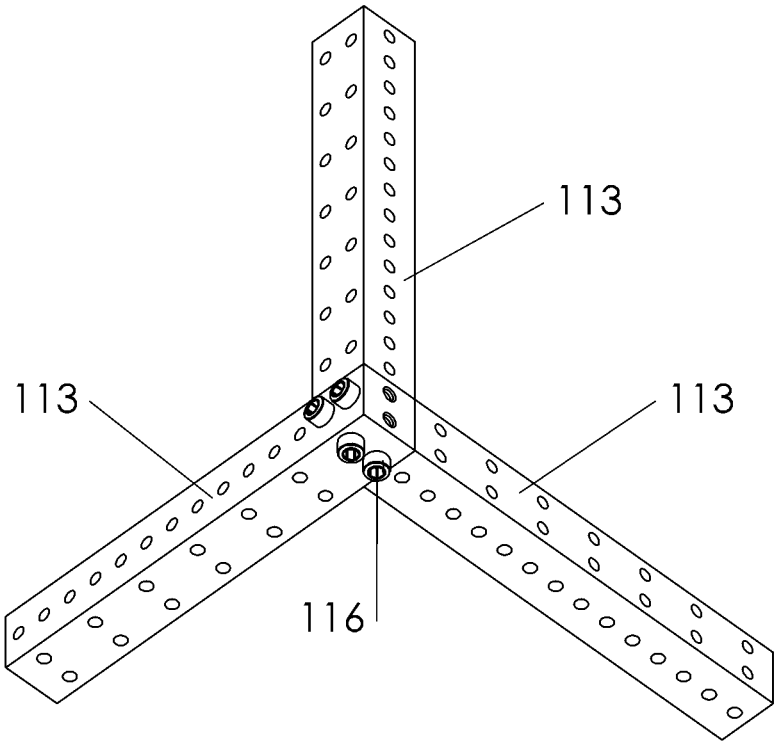
FIG. 9A shows an example of a three-dimensional corner assembled with innovative three-dimensional grid beams of the kind described as the first embodiment of the present invention.
Figure 9B:
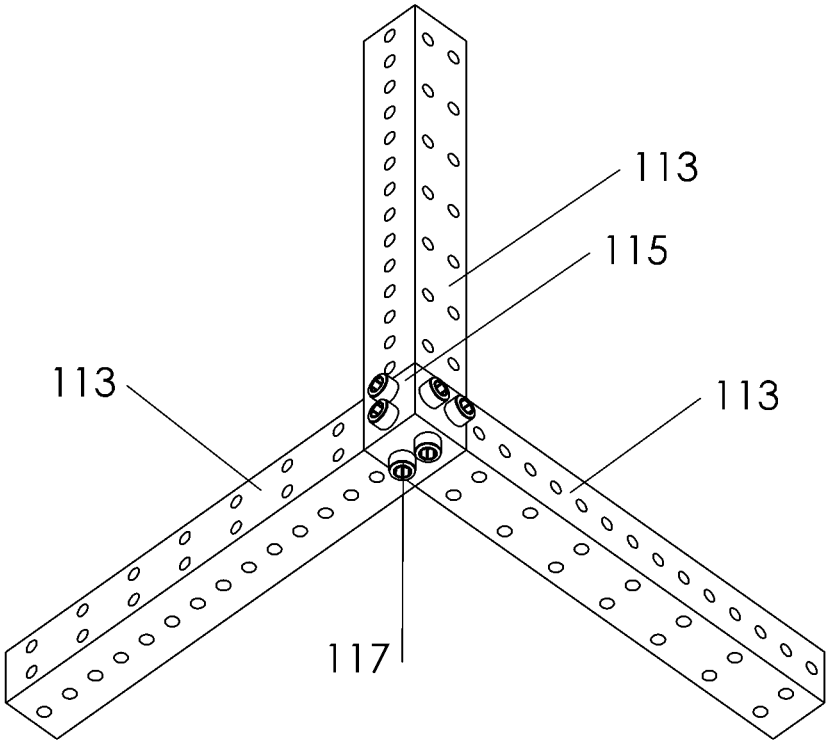
FIG. 9B shows example of a three-dimensional corner assembled with innovative three-dimensional grid beams of the kinds described as the first and the third embodiments of the present invention.

Presented on FIG. 9B is another method of forming ideal corners, this time using beams of the kinds described as the first and the third embodiments of the present invention. As shown on FIG. 9B, three beams 113 of the kind described as the first embodiment of the present invention are connected to a cube (N=1) beam 115 of the kind described as the third embodiment of the present invention through connectors 117. Not only does this structure form a "perfect" corner, similar to the one presented on FIG. 9B, but it also is completely symmetrical, which wasn't the case for FIG. 9A. Thus, the second object of the present invention is achieved.

Figure 10:
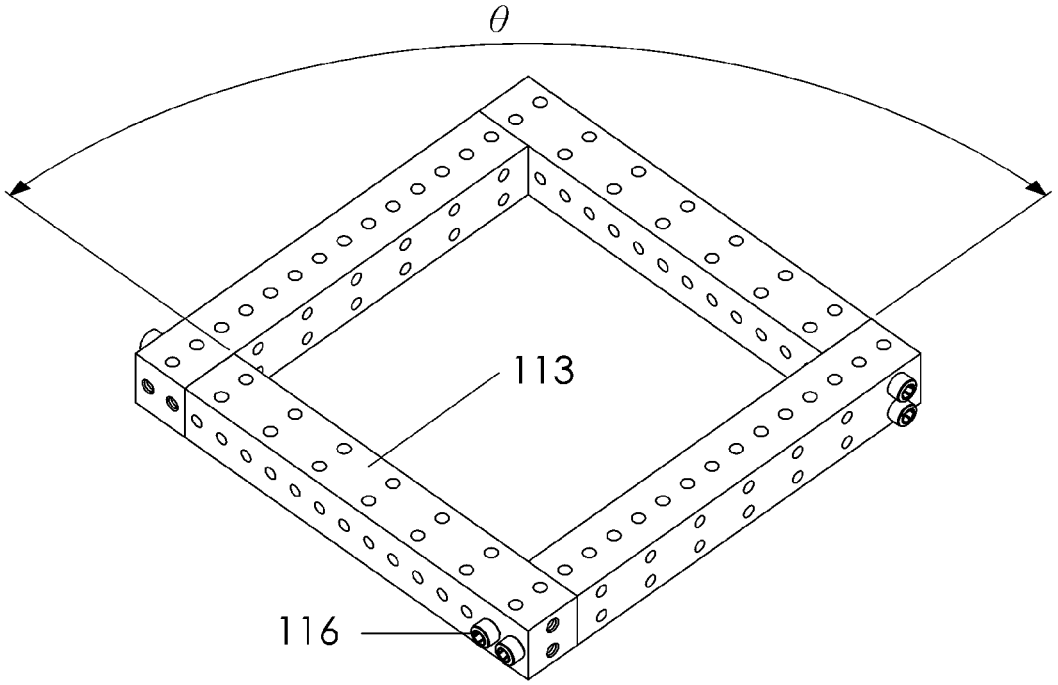
FIG. 10 shows a rectangular structure formed with innovative three-dimensional grid beams of the kind described as the first embodiment of the present invention.

As each section of the innovative three-dimensional grid beam according to the preferred embodiment of the present invention has two holes per an exposed section side, assemblies made of said beams are self-supporting and do not explicitly require diagonal braces. Referring now to FIG. 10, there shown a rectangular structure formed with beams 113 of the kind described as the first embodiment of the present invention and screws 116. As each beam-to-beam joint is formed by flat beam surfaces and secured by two screws, is allows to achieve a right angle θ with excellent precision, and the resulting structure is able to maintain rectangular shape and rigidity without the explicit need for a diagonal brace. Thus, the third object of the present invention is achieved.

Figure 8C:
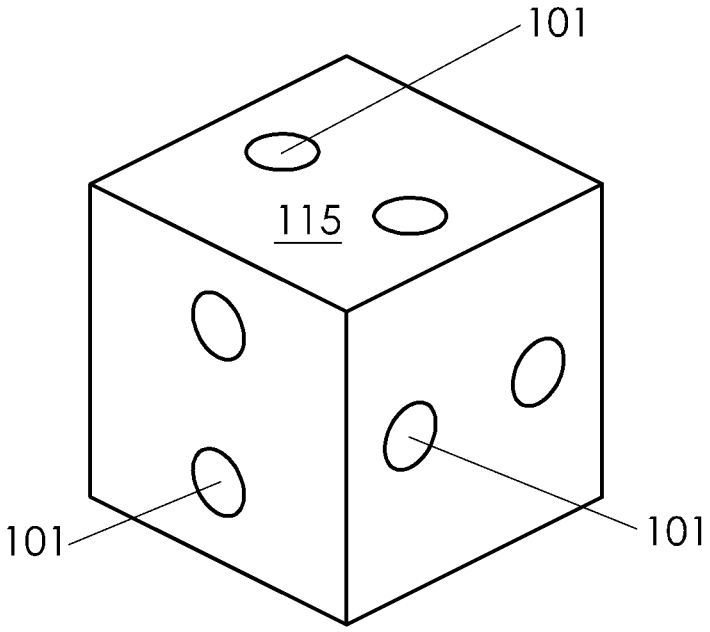
FIG. 8C shows the third embodiment of the present invention, whereas all holes of the innovative three-dimensional grid beam are plain (non-threaded), and whereas the number of steps N is equal to one.

It is envisioned that a complete construction set utilizing the innovative three-dimensional grid beam of the present invention may only include beams of three kinds: the beam 113 described as the first embodiment of the present invention (FIG. 8A), the beam 114 described as the second embodiment of the present invention (FIG. 8B), and the beam 115 described as the third embodiment of the present invention (FIG. 8C).

Further, it is only necessary to offer beams of varying length for beams 113. Beams 114 and 115 can be offered only in single-step versions, i.e. as "cubes".

Figure 11:
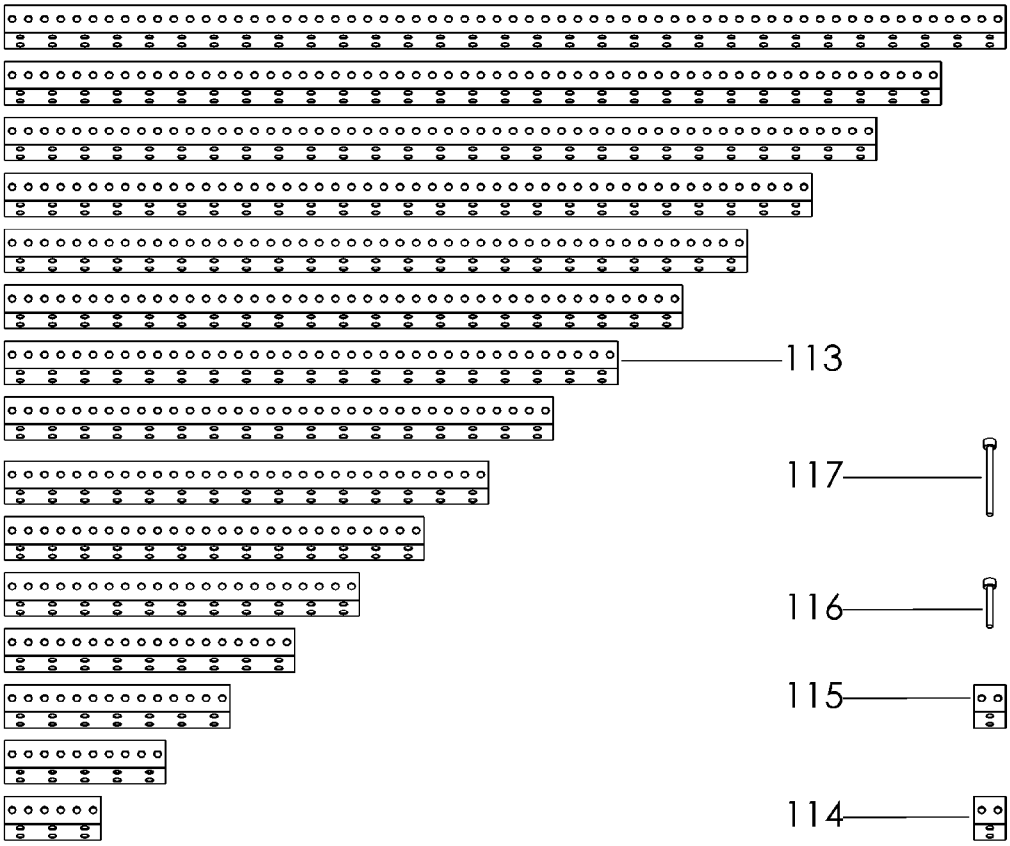
FIG. 11 shows the parts comprising the innovative construction set of the present invention.

The innovative construction set of the present invention is presented on FIG. 11. The kit comprises innovative three-dimensional grid beams 113, supplied in a variety of lengths. The kit further comprises innovative three-dimensional grid beams 114 and 115 supplied in single-step versions. Finally, the kit also comprises the screws of the S/5 diameter, supplied in two lengths: S×1.5 (116) and S×2.5 (117).

Screws 116 are used most often, for example, to hold together the structures presented on FIG. 9A, FIG. 9B, and FIG. 10. The use of screws 117 is explained later.

It has been found through practical experiments that the maximum number of steps N for the innovative three-dimensional beams of the present invention may be around 31. Longer beams are impractically flexible, even when manufactured from stainless steel. Nevertheless, this empirical number is only provided as a reference and should not be viewed as limiting the spirit or the scope of the present invention in any way.

Figure 12:
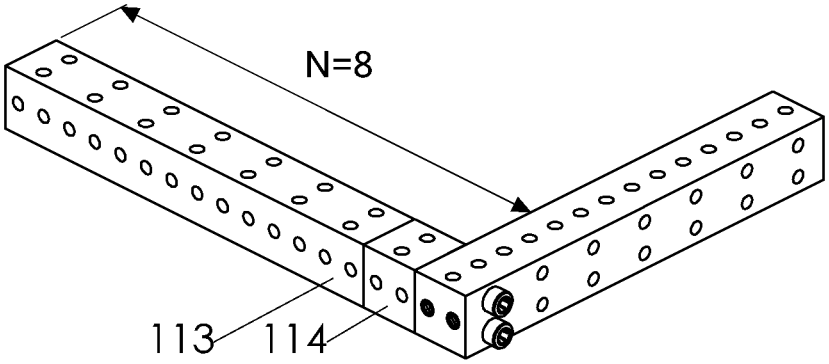
FIG. 12 shows the technique of forming combinatorial three-dimensional beams with the even number of steps N out of innovative three-dimensional grid beams of the kinds described as the first and the third embodiments of the present invention.

Experiments in building actual structures made of innovative three-dimensional beams of the present invention also show that it is almost always possible to erect the required structure entirely from beams comprising an odd number of sections, i.e. N=3, 5, 7, . . . 31. Even lengths, when absolutely necessary, may be achieved by adding a single-step beam 115 to a beam 113. Such a combinatorial grid beam (N=8) is presented on FIG. 12. Screws 117, which have the length of S×2.5, are used to tie the presented corner together, and this explains the need for screws 117.

It must be noted that FIG. 11 only presents the different kinds of members that are envisioned to be included with the innovative construction set of the present invention. Those skilled in the art will realize that multiples of parts of the same kind may be needed in a single kit.

The innovative three-dimensional grid beam of the present invention may be scaled to various values of S and offered in several size versions.

According to one embodiment of the present invention, the step S is equal to 10 mm. Thus, the grid beam according to this embodiment of the present invention consists of 1 cm×1 cm×1 cm sections and utilizes M2 screws.

According to another embodiment of the present invention, the step S is equal to 50 mil.

Heftier grid beams, such as beams with S=20 mm or S=100 mil are contemplated as well. All such variations are completely within the spirit and the scope of the present invention.

It is envisioned that all necessary additional specialized parts that are invariably required to complete any real-life project may be printed quickly and inexpensively using a desktop 3D printer. At the time of writing, such 3D printers have already achieved a price point and the output quality suitable for printing abovementioned specialized parts.

Figure 13:
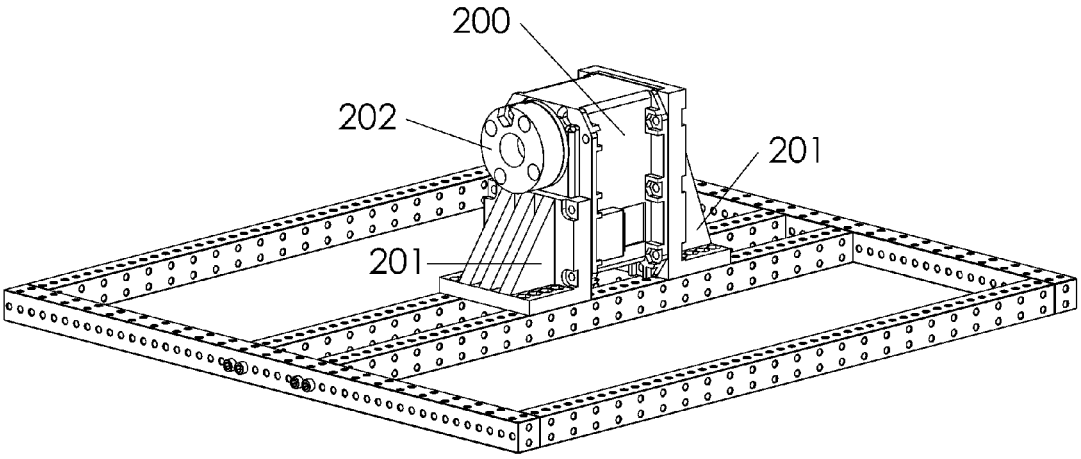
FIG. 13 presents a fragment of an assembly erected with parts comprising the innovative construction set of the present invention, as well as specialized parts manufactured on a 3D printer.

As an example, FIG. 13 presents a fragment of an assembly erected with innovative three-dimensional beams of the present invention and specialized parts manufactured on the 3D printer. In this example, a miniature servo motor 200 is secured to the three-dimensional grid beams of the present invention with custom-made brackets 201. The motor has a custom-made wheel 202 attached to it. Both the brackets 201 and the wheel 202 are manufactured on the 3D printer, while the rigid skeletal structure for the assembly is made of the three-dimensional grid beams of the present invention.

The above example illustrates the use of the innovative three-dimensional grid beam of the present invention in conjunction with custom-designed 3D-printed parts. At the time of writing, desktop 3D printing technology has advanced to the point where it became possible to inexpensively and quickly print small plastic parts, but there remained a lot of constraints on the size of parts printed, as well as the ratio between the width, height, and thickness of such parts. For example, a rather thick bracket 201 printed on a desktop 3D printer would typically be very sturdy. At the same time, an attempt to replace a grid beam of the present invention with a similar part fabricated on a 3D printer would result in a weak and wobbly output, rendering such 3D printed part useless. In addition, printing large parts using modern 3D technology is an extremely time-consuming process that makes any attempt to make such parts en masse impractical. Relatively small parts, on the other hand, can be produced quickly. Combined with the innovative construction set of the present invention, they allow the designer to rapidly create sophisticated fixtures, machines, apparatus, and assemblies that are sturdy and precise enough for industrial and laboratory applications.

To summarize, the innovative construction set using the innovative three-dimensional grid beam of the present invention may be formed with only 15 sizes of the beam 113 (FIG. 8A, N=3, 5, 7, . . . 31), a single size of the beam 114 (FIG. 8B, N=1), a single size of the beam 115 (FIG. 8C, N=1), and the screws 116 and 117. All specialized parts can be manufactured quickly and inexpensively using the existing 3D printing technology. Thus, the fourth object of the present invention is achieved.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that structures within the scope of these claims and their equivalents be covered thereby.

What is claimed is:

1. A three-dimensional grid beam comprising:

a cuboid solid block defined by six faces, three adjacent faces of which being substantially perpendicular to each other;

said six faces consisting of a first pair of opposing faces, a second pair of opposing faces, and a third pair of opposing faces, each face of said first and second pair of opposing faces having a length (L), and a width (S), and each face of said third pair of opposing faces having equal sides (S), said three-dimensional grid beam is consisting of a number (N) of sections, each of said sections having a length (S), a width (S) and a height (S) that are identical, wherein the number of sections is a positive integer greater than 1, and the length (S) of each of the sections defines a grid step length of said three-dimensional grid beam;

said cuboid solid block having several pairs of first holes formed on each face of said first pair of opposing faces, each of said pairs of the first holes defining therebetween a first centerline extending across each face of said first pair of opposing faces and perpendicularly to a longitudinal axis of said cuboid solid block;

said cuboid solid block having several pairs of second holes formed on each face of said second pair of opposing faces, the holes of each of said pairs of the second holes defining therebetween a second centerline extending across each face of said second pair of opposing faces, the second centerline being parallel to said longitudinal axis of said cuboid solid block, and each pair of said pairs of the second holes being spaced from an adjacent pair of said pairs of the second holes on each of said second pair of opposing faces by a distance equal to the width (S) of said second pair of opposing faces; and said cuboid solid block having one pair of third holes formed on each face of said third pair of opposing faces, said pair of the third holes defining therebetween a third centerline extending across each face of said third pair of opposing faces and perpendicularly to said longitudinal axis of said cuboid solid block, wherein each of said sections can be substantially divided into two identical portions according to said first centerline, said second centerline or said third centerline, and said first holes, said second holes and said third holes do not orthogonally intersect with each other.

2. The three-dimensional grid beam according to claim 1, wherein said cuboid solid block is made from one material selected from a group consisting of metal, metal alloy, plastic, reinforced plastic, and combinations thereof.

3. The three-dimensional grid beam according to claim 2, wherein said cuboid solid block is manufactured using a manufacturing method selected from a group consisting of injection molding, computer numerical control (CNC) machining, drilling, and combinations thereof.

4. The three-dimensional grid beam according to claim 1, wherein the distance between the holes of each of said pairs of the first holes, the second holes or the third holes substantially equals to half (S/2) of the length of said section.

5. The three-dimensional grid beam according to claim 1, wherein said first and second holes formed on each face of said first and second pairs of opposing faces are through holes.

6. The three-dimensional grid beam according to claim 1, wherein said first and second holes formed on each face of said third pair of opposing faces are blind holes.

7. The three-dimensional grid beam according to claim 6, wherein said third holes formed on each face of said third pair of opposing faces extend to a depth substantially equal to half (S/2) of the length of said section.

8. The three-dimensional grid beam according to claim 1, wherein all of said first holes, said second holes and said third holes are threaded.

9. The three-dimensional grid beam according to claim 1, wherein all of said first holes, said second holes and said third holes are non-threaded.

10. The three-dimensional grid beam according to claim 1, wherein said first holes and said second holes on each face of said first and second pairs of opposing faces are non-threaded, and said third holes on each face of said third pair of opposing faces are threaded.

11. A construction set comprising:

a plurality of three-dimensional grid beams with connectors for interconnecting said three-dimensional grid beams in a releasable manner, wherein said three-dimensional grid beam comprise:

a cuboid solid block defined by six faces, three adjacent faces of which being substantially perpendicular to each other;

said six faces consisting of a first pair of opposing faces, a second pair of opposing faces, and a third pair of opposing faces, each face of said first and second pair of opposing faces having a length (L), and a width (S), and each face of said third pair of opposing faces having equal sides (S) said three-dimensional grid beam is consisting of a number (N) of sections, each of said sections having a length (S), a width (S) and a height (S) that are identical, wherein the number of sections is a positive integer greater than 1, and the length (S) of each of the sections defines a grid step length of said three-dimensional grid beam;

said cuboid solid block having several pairs of first holes formed on each face of said first pair of opposing faces, each of said pairs of the first holes defining therebetween a first centerline extending across each face of said first pair of opposing faces and perpendicular to a longitudinal axis of said cuboid solid block;

said cuboid solid block having several pairs of second holes formed on each face of said second pair of opposing faces, the holes of each of said pairs of the second holes defining therebetween and is equidistant from a second centerline extending across each face of said second pair of opposing faces, the second centerline being parallel to said longitudinal axis of said cuboid solid block, and each pair of said pairs of the second holes being spaced from an adjacent pair of said pairs of the second holes on each of said second pair of opposing faces by a distance equal to the width (S) of said second pair of opposing faces; and said cuboid solid block having one pair of third holes formed on each face of said third pair of opposing faces, said pair of the third holes defines therebetween a third centerline extending across each face of said third pair of opposing faces and perpendicularly to said longitudinal axis of said cuboid solid block, wherein each of said sections can be substantially divided into two identical portions according to said first centerline, said second centerline or said third centerline, and said first holes, said second holes and said third holes do not orthogonally intersect with each other.

12. The construction set according to claim 11, wherein said connectors are screws having a diameter corresponding to that of said first holes, said second and said third holes of said hole pairs of said three-dimensional grid beams.

13. The construction set according to claim 11, wherein each of said connectors has a length substantially equal to 1.5 times the grid step length.

14. The construction set according to claim 11, wherein each of said connectors has a length substantially equal to 2.5 times the grid step length.

* * * * *